United States Patent [19]

Nikaido

[11] Patent Number: 4,538,966

[45] Date of Patent: Sep. 3, 1985

[54] OIL PUMP ASSEMBLY

[75] Inventor: Masaya Nikaido, Higashimatsuyama, Japan

[73] Assignee: Jidosha Kiki Co., Ltd., Tokyo, Japan

[21] Appl. No.: 482,321

[22] Filed: Apr. 5, 1983

[30] Foreign Application Priority Data

Apr. 19, 1982 [JP] Japan ..... 57-64989

[51] Int. Cl.[3] ..... F04B 49/08; F04C 2/00; F04C 11/00

[52] U.S. Cl. ..... 417/288; 417/299; 418/102; 418/133; 418/212

[58] Field of Search ..... 417/286, 304, 308, 288, 417/299, 287; 418/212, 102, 133

[56] References Cited

U.S. PATENT DOCUMENTS

| | | | |
|---|---|---|---|
| 2,411,606 | 11/1946 | Wilson | 417/286 |
| 2,720,171 | 10/1955 | Harrington et al. | 418/212 |
| 3,985,472 | 10/1976 | Virtue et al. | 417/287 X |
| 4,116,577 | 9/1978 | Lauck | 417/286 |
| 4,412,789 | 11/1983 | Ohe et al. | 417/288 |

FOREIGN PATENT DOCUMENTS

| | | | |
|---|---|---|---|
| 52-14903 | 2/1977 | Japan | 418/212 |

OTHER PUBLICATIONS

Japanese Preliminary Patent Publication No. Sho 57-28889, published on Feb. 16, 1982.

*Primary Examiner*—Carlton R. Croyle
*Assistant Examiner*—Theodore Olds
*Attorney, Agent, or Firm*—Charles E. Pfund

[57] ABSTRACT

An oil pump assembly comprises a pump body assembly composed of a pair of front and rear pump bodies, the rear pump body housing in a pump housing space a pair of pumps each including a pump cartridge having a rotor supported on a common drive shaft rotatably supported on the front pump body, and a cam ring accommodating the rotor. A single side plate is axially slidably interposed between the pump cartridges. A pressure plate is disposed between one of the pump cartridges remote from the front pump body and a pump discharge pressure chamber defined at the bottom of the pump housing space and communicating with a main passage through which one of the pumps communicates with a discharge port. The other pump is selectively connected by a directional control valve to the main passage. The pump and valve parts can easily be assembled into the pump bodies, and hence the oil pump assembly can be mass-produced efficiently, less costly, and is small in size and lightweight.

3 Claims, 12 Drawing Figures

OIL PUMP ASSEMBLY

BACKGROUND OF THE INVENTION

The present invention relates to an oil pump assembly, particularly an oil pump assembly having a pair of pumps and a control unit for selectively supplying a fluid under pressure from the oil pumps to a fluid-pressure-actuated device.

Power steering systems are installed on automobiles to reduce the driver's effort needed to turn heavy steering wheels. The hydraulic source used in the power steering system comprises a pump driven from the automobile engine. The amount of a fluid discharged under pressure by the pump varies in proportion to the RPM of the engine. Therefore, it is required that the pump have a capacity to supply the fluid at a rate large enough to operate the fluid-pressure-actuated device such as a power steering gearbox even when the engine rotates at low speeds, that is, when the amount of the fluid discharged from the pump is small.

With such a pump capacity setting, the pump will supply the fluid at an unnecessarily large rate when the engine rotates at higher speeds. The pump capacity therefore results in unnecessary circulation of the fluid through the power steering system. The engine power consumed for driving the pump is increased to the point where the fuel economy of the engine is adversely affected. The foregoing pump arrangement is undersirable from the standpoint of energy saving.

To avoid such a difficulty, there has heretofore been proposed a pump assembly including two small-capacity pumps combined with a control unit for selectively supplying a fluid from the pumps to the fluid-pressure-actuated device. Under normal conditions, only one of the pumps is in operation to supply a fluid pressure, while the other pump is connected to a fluid tank under no load, thereby reducing the power consumption requirement. When need arises, the control unit is operated to enable both of the pumps to discharge pressurized fluid flows that are combined and supplied to the power steering gearbox. Various means are known for controlling the amount of fluid to be supplied under pressure. One control means comprises an engine RPM sensing system in which the rate of fluid flow is detected when the engine rotation is slow or when the amount of fluid discharge from the pump is small, for enabling the two pumps to produce a combined flow of fluid under pressure. According to a pressure-sensitive system, the two pumps are actuated to supply a combined fluid flow in response to detection of a pressure build-up developed in a fluid supply passage only when the power steering gearbox is operated or put under load irrespective of the engine RPM. Still another system is a combination of the above two systems, incorporating the advantages thereof. These known systems are selectively used to suit a particular application. The foregoing control unit is required to have the passage switching function to effect selective switching between the passages leading from the pumps, and the flow rate controlling function to keep the rate of fluid flow to the power steering gearbox below a predetermined level. It is general practice to perform these functions by using a pair of spool valves and fluid passages combining the spool valves.

It is important in constructing the oil pump assembly of the type described that the two pumps, two spools, and interconnecting passages be assembled in a single pump body in a manner to allow efficient operation, and the parts be machined and assembled easily for achieving a reduction in the manufacturing cost.

Accordingly, there is a need for oil pump assemblies which are simple in construction, can be assembled with ease, are small in size and lightweight. These requirements are particularly demanded for power steering units that will be mounted in a small space such as an engine room.

To meet the above requirements, it is generally necessary that the assemblage of the pumps on a common drive shaft in the pump body be simplified, taking into account the structural relationship between the pumps, the fluid passages from the pumps, and the spool valves for controlling the flow of the fluid. The control unit widely varies in structure from sensor system to sensor system. It is therefore desirable that the parts, especially the pump body, be constructed in order to be shared by different control unit structures, for thereby increasing the mass production capability.

SUMMARY OF THE INVENTION

With the foregoing problems and demands in view, it is an object of the present invention to provide an oil pump assembly which has a simplified structure composed of a reduced number of parts for allowing pumps to be assembled in a pump body, can be machined and assembled with utmost ease, and can be mass-produced highly efficiently.

Another object of the present invention is to provide an oil pump assembly which can be manufactured less costly, and is small in size and lightweight.

Still another object of the present invention is to provide an oil pump assembly which is an energy saver, reliable in operation, and durable in construction.

According to the present invention, an oil pump assembly comprises a pump body assembly composed of a pair of front and rear pump bodies, the rear pump body housing in a pump housing space a pair of pumps each including a pump cartridge having a rotor supported on a common drive shaft rotatably supported on the front pump body, and a cam ring accommodating the rotor. A single side plate is axially slidably interposed between the pump cartridges. A pressure plate is disposed between one of the pump cartridges remote from the front pump body and a pump discharge pressure chamber defined at the bottom of the pump housing space and communicating with a main passage through which one of the pumps communicates with a discharge port. The other pump is selectively connected by a directional control valve to the main passage.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
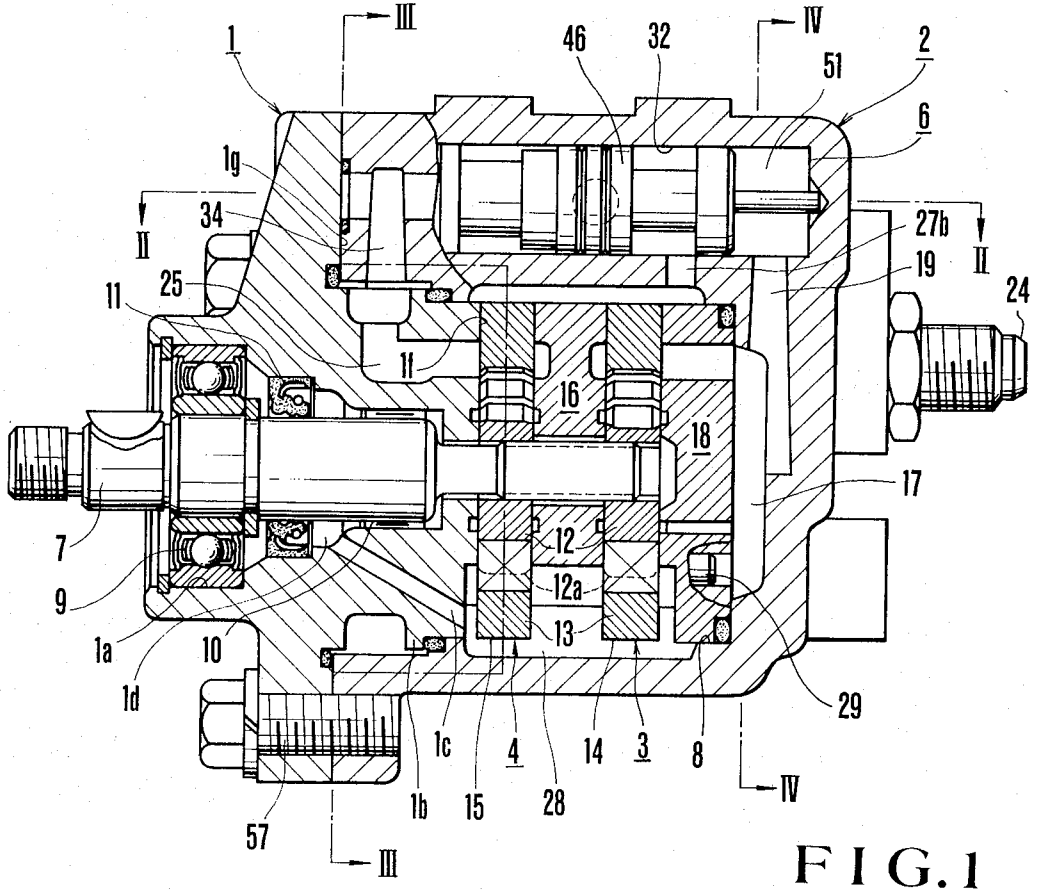
FIG. 1 is a vertical cross-sectional view of an oil pump assembly constructed in accordance with the present invention.

The present invention is particularly useful when embodied in an oil pump assembly as shown in FIGS. 1 through 5, for flow rate control of the RPM- and pressure-sensitive type.

The oil pump assembly has a pump body assembly composed of a front body 1 and a rear body 2 and housing a pair of first and second pumps 3, 4 of a small discharge capacity, and a pair of first and second spool valves 5, 6 for controlling the amounts of fluid discharged under pressure from the first and second pumps 3, 4, respectively. The first and second pumps valves 3, 4 and the first and second spool valves 5, 6 are interconnected by fluid passages. For increased energy saving capability, the first pump 3 serving as a main pump should be capable of a smaller rate of discharge fluid than the rate of discharge fluid than the second pump 4. However, the first pump 3 may be of a discharge capacity identical to or greater than that of the second pump 4.

According to the present invention, the first pump 3 or main pump is mounted in the rear body 2, and the second pump 4 or auxiliary pump is mounted in the front body 1 more closely than the first pump 3 to the rear body 2, making the pump assembly simple. The pumps 3, 4 are driven by a common drive shaft 7 rotatably supported by the front body 1.

Figure 3:
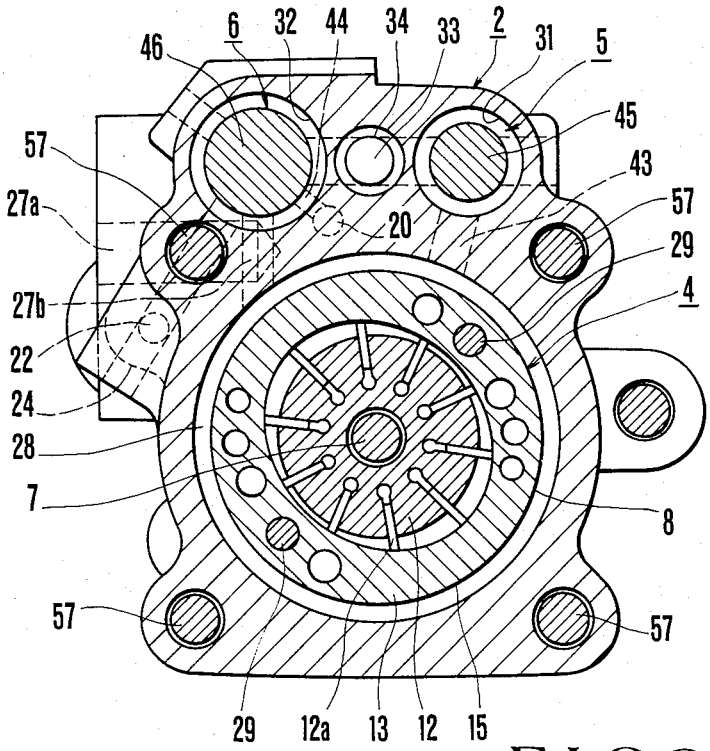

More specifically, as illustrated in FIGS. 1 and 3, the rear body 2 has a bottomed central pump housing space 8 opening toward the front body 1. The first and second pumps 3, 4 are disposed in the pump housing space 8 and axially juxtaposed at positions spaced from the space 8. The pumps 3, 4 are driven for pumping action by the common drive shaft 7 inserted through a central hole 1*a* defined in the front body 1.

The drive shaft 7 is rotatably supported by a pair of bearings 9, 10 mounted in the central hole 1*a* at axially spaced intervals. An oil seal 11 is also mounted in the central hole 1*a* in surrounding relation to the drive shaft 7.

Each of the first and second pumps 3, 4 is of a known vane pump construction, and is fixed as by splines to an inner end portion of the drive shaft 7. The first and second pumps 3, 4 comprise first and second pump cartridges 14, 15, respectively, each composed of a rotor 12 having a plurality of radial vanes 12*a*, and a cam ring 13 accommodating the rotor 12 therein and having a cam face defining a pump chamber.

Figure 4:
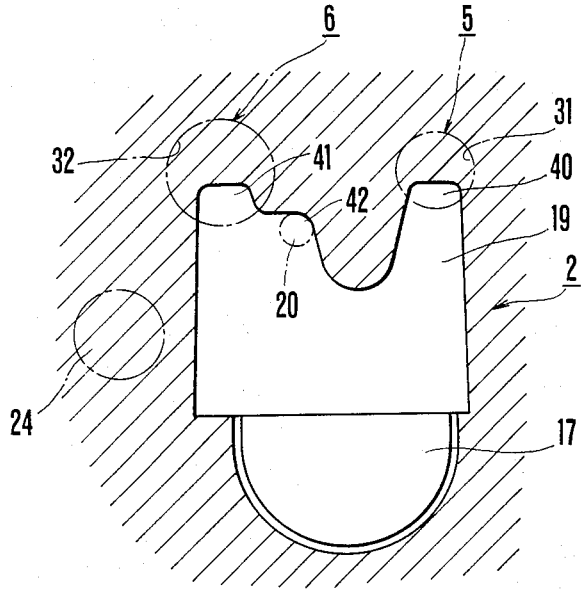

A single side plate 16 is axially slidably interposed between the pump cartridges 14, 15 and is shared by the pumps 3, 4. The pump housing space 8 has in its bottom a pressure chamber 17 at a discharge port of the first pump 3 for introducing therein a pressurized fluid from the first pump 38, the pressure chamber 17 being in the form of a recess having a diameter smaller than the space 8. A pressure plate 18 is interposed between the pressure chamber 17 and the first pump cartridge 14. As shown in FIGS. 1 and 4, the pressure chamber 17 communicates with a discharge port 24 at a rear end of the rear body 2 through a main passage 23 comprising a passageway 19, and passage holes 20, 21 and 22.

The front body 1 has a cylindrical portion 1*b* fitted in and closing off the opening in the pump housing space 8 in the rear body 2. The cylindrical portion 1*b* has an inner end 1*f* held against a side surface of the second pump cartridge 15 to support the latter in place. The front body 1 serves as a pressure plate for the second pump 4, and has an auxiliary passage 25 doubling as a pressure chamber at a discharge port of the second pump 4 for guiding fluid pressure from the second pump 4 to the spool valve 5 which has the function of switching fluid passages. As shown in FIGS. 1 and 3, the pump housing space 8 has, in its inner wall surrounding the first and second pump cartridges 14, 15, a pressure chamber 28 at suction ports of the pumps which guides the working fluid from a suction port 26 defined in a side of the rear body 2 through passageways 27*a*, 27*b*. Designated at 29 are positioning pins for positioning the pump cartridges 14, 15, the side plate 16, the pressure plate 18, and the front body 1 in the direction of rotation. The components of the pumps 3, 4 are held out of alignment in the rotational direction to provide out-of-phase pulsations of the discharge pressures from the pumps, for smooth pumping action.

With the foregoing pump assembling arrangement, the front body 1 doubles as one of the pressure plates. The pump cartridges 14, 15 and the side plate 16 interposed therebetween are sandwiched between the front body 1 and the pressure plate 18 under a pressure difference developed therebetween. Any resilient means such as springs conventionally used for urging the pressure plates against the pump cartridges can be dispensed with. The various parts can easily and reliably be sealed off, are minimized in number, and can be assembled with ease. Since the drive shaft 7 on which the pump cartridges 14, 15 are mounted in tandem is rotatably supported by the front body 1, the components can readily be assembled together, and will operate highly reliably.

The front body 1 can easily be fabricated as by die-casting. With the drive shaft 7 rotatably supported by the front body 1, there is no problem of the lack of coaxial alignment between the pump cartridges 14, 15, the side plate 16 and the pressure plate 18. This allows the pump housing chamber 8 to be machined in the rear body 2 without requiring a high degree of accuracy. Thus, the parts can be machined and assembled advantageously. The above advantages also result from the provision of the pressure chamber 28 at the suction ports of the pumps which extends around the pump cartridges 14, 15.

The pressure chamber 28 is held in communication through a passageway 1*c* with an annular slot 1*d* defined inwardly of the oil seal 11 which seals the drive shaft 7 within the central hole 1*a* in the front body 1. The passageway 1*c* permits the oil seal 11 to be cooled at all times by the working fluid from the suction ports of the pumps. The oil seal 11 is therefore prevented from being degraded. Since the working fluid circulates at all times around the drive shaft 7, the latter is free of the problem of seizure and is durable in operation.

With the foregoing the pump assembling construction, the first pump 3 closer to the rear body 2 is normally connected to the discharge port 24 and maintained under a high pressure condition, forcing the pumps toward the front body 1. This renders the pumps free of any problem during operation. When the auxiliary passage 25 from the second pump 4 is connected to the discharge port 24 through the passage switching spool valve 5, the pumps are urged by the pressure plate 18 toward the front body 1 due to the difference between pressure-bearing surface areas of the auxiliary passage 25 and the pressure chamber 17 at the discharge port of the first pump 3. Therefore, no problem arises in operation.

The above simple structure allows the oil pump assembly with the two pumps 3, 4 incorporated therein to be machined and assembled with ease, with the result that the oil pump assembly can be manufactured less costly on an improved mass production basis.

The rear body 2 houses in the pump housing space 8 a control unit composed of the spool valves 5, 6 and the fluid passages for selectively supplying the pressurized fluid from the first and second pumps 3, 4 to a fluid-pressure-actuated device such as a power steering unit through the discharge port 24 opening at the rear end of the rear body 2.

A pair of valve holes 31, 32 is defined in an upper portion of the rear body 2 in parallel close relationship. The valve holes 31, 32 open at the junction 1*g* between the front and rear bodies 1, 2 as does the pump housing space 8, and have axes parallel to the axis of the pump housing space 8. The valve holes 31, 32 as well as the pump housing space 8 are closed off by the front body 1 with a liquidtight seal. The valve hole 32 has a portion extending toward the front body 1.

A passage hole 33 is defined in the rear body 2 between the valve holes 31, 32 and has an end opening at the junction face of the rear body 2. The passage hole 33 has an axis substantially lying in the same plane as that in which the axes of the valve holes 31, 32 lie. The open end of the passage hole 33 is closed off by the junction face of the front body 1. The passage hole 33 communicates with the auxiliary passage 25 extending from the second pump 4 through a passageway 34 opening into the passage hole 33 adjacent to the open end thereof. The other end of the passage hole 33 extends axially to a substantially central portion of the rear body 2, and is connected to a passage hole 35 extending from a side of the rear body 2 through the valve hole 31. The passage hole 33 communicates through a passageway 36 opening into the valve hole 32 at its central portion.

A fluid under pressure discharged from the second pump 4 flows through the passageway 34 and the passage hole 33 into the central portion of the valve hole 31. The passageway 36 is normally closed off by a spool 46 (described later) slidably disposed in the valve hole 32. The end of the passage hole 35 opening at the side of the rear body 2 is closed off by a blind plug 37.

The passage hole 20 which is part of the main passage 23 extends from a rear end of the rear body 2 in a side portion thereof and parallel to the pump housing space 8 and the valve holes 31, 32. The passage hole 20 communicates with the discharge port 24 through the valve hole 32 and the passage holes 21, 22, FIG. 5. The open ends of the passage holes 20, 21 are closed off by balls 20*a*, 21*a*.

Figure 5:
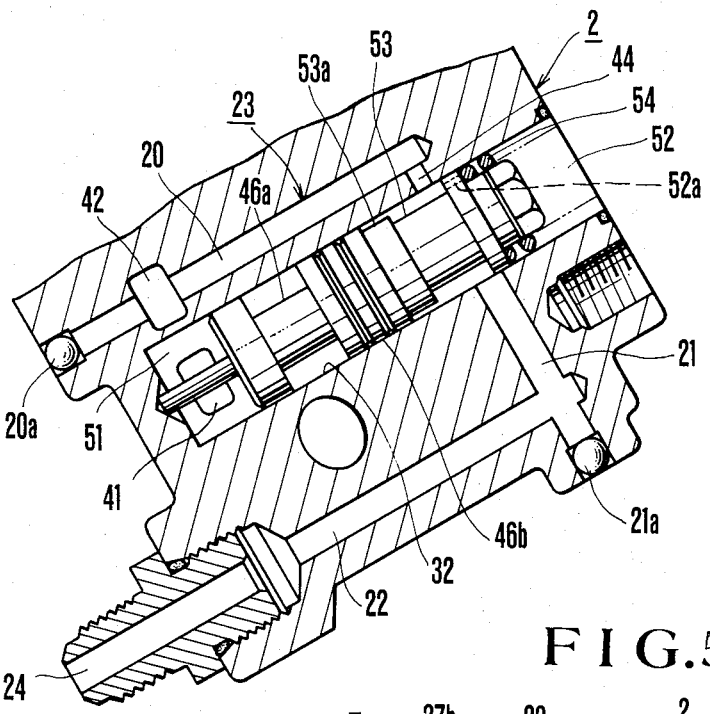
FIG. 5 is a cross-sectional view of a rear body, showing a main passage leading to a discharge port.

As shown in FIGS. 3 and 4, the pump housing space 8 communicates with the valve holes 31, 32 and the passage hole 20 through the passageway 19 connected to the pressure chamber 17 in the bottom of the pump housing space 8 and substantially rectangular passage slots 40, 41, 42 defined in the rear body 2. A return passage slot 43 is defined in the rear body 2 and opens into the first valve hole 31 at a position rearward of the passage hole 35 through which the fluid flows from the second pump 4. The return passage slot 43 communicates with the pump housing space 8 at a position corresponding to the pressure chamber 28 at the suction port of the second pump 4. The passageway 27*b* which communicates with a suction port 26 extending from a side of the rear body 2 opens into the second valve hole 32 at a position rearward of the center of the second valve hole 32. As illustrated in FIG. 1, the passageway 26*b* is connected to the pump housing space 8 at a position corresponding to the pressure chamber 28 at the suction port of the second pump 4. In FIG. 5, a small-diameter orifice 44 communicates between the passage hole 20 and the valve hole 32 for actuating the spool valve 6 which serves as a flow rate control valve (described later) to detect the rate of flow of the fluid supplied to the fluid-pressure-actuated device.

The valve holes 31, 32 house therein spools 45, 46, respectively, constituting the first and second spool valves 5, 6 which serve as a flow passage switching valve or directional control valve and a flow rate control valve, respectively.

The spool 45 placed in the first valve 31 is normally positioned at the rear end of the rear body 2 by a pair of larger-and smaller-diameter springs 47*a*, 47*b* at the front end of the valve hole 31. In this position, the passage hole 35 communicates with the return passage slot 43 through an annular space around a rod 45*a* projecting from the front end of the spool 45. The fluid under pressure from the second pump 4 thus returns to the suction ports of the pumps. A check valve 48 is mounted on the rear end of the spool 45, and will be connected to the passage holes 33, 35 from the second pump 4 through a through hole 45*b* and an annular groove 45*c* in the spool 45 when the latter is moved to the front end of the valve hole 31. When the spool 45 is thus operated, the return passage slot 43 is disconnected from the passage hole 35 by a land 45*d* on the spool 45. The check valve 48 is opened by the pressurized fluid from the second pump 4 to allow the fluid to flow through the passage slot 40 opening at the rear end of the valve hole 31 into passageway 19 communicating with the pressure chamber 17 at the discharge port of the first pump 3, the fluid thus directed being mixed with the fluid discharged from the first pump 3. A high-pressure chamber 49 defined at the rear end of the spool 45 in the first spool valve 5 is supplied with a fluid pressure from the pressure chamber 17 through the passage slot 40. A low-pressure chamber 50 at the front end of the spool 45 is supplied with a fluid pressure from the suction port through the return passage slot 43. The spool 45 serves as a pressure-sensitive flow passage switching valve actuatable for flow passage switching in response to detection of a fluid pressure buildup developed by an increase in the load on the fluid-pressure-actuated device in the pressure chamber 17, the passageway 19, the passage slot 42 and the main passage composed of the passage holes 20, 21, 22 with the orifice 44 therein.

The larger-and smaller-diameter springs 47*a*, 47*b* for urging the spool 45 toward the rear end of the valve hole 31 for the purpose of reducing any trouble due to an abrupt pressure buildup as a result of mixture of the fluid from the second pump 4 and the fluid in the main passage 23 when the spool 45 is operated. The spool 45 is urged by the springs 47*a*, 47*b* under an urging force of non-linear characteristics for dampening the movement of the spool 45. The spool 45 has in its front end an annular groove 45*e* serving also to dampen the movement of the spool 45.

The spool 46 mounted in the second valve hole 32 acts as a known flow rate controlling valve, and also as a flow passage switching valve because of the presence of the passageway 46*a*. More specifically, the fluid pressure in the pressure chamber 17 or upstream of the flow rate detecting orifice 44 is introduced through the passage slot 41 into the high-pressure chamber 51 defined at the rear end 32 by the spool 46. The fluid pressure downstream of the orifice 44 is introduced through the passage hole 20 communicating with the pressure chamber 17 into a stepped annular groove 53 defined near the low-pressure chamber 52 at the front end of the spool 46. The spool 46 is normally positioned at the rear end of the valve hole 32 by a spring 54 placed in the low-pressure chamber 52. In this position, an annular slot 46*a* defined centrally around the spool 46 faces the passageway 27*b* communicating with the suction port 26, and the pressure chamber 17 is disconnected from the passageway 27*b*. Further, the passageway 36 is closed off by a land 46*b* on the spool 46. When the rate of flow of the fluid from the pressure chamber 17 is increased to a level beyond a predetermined level, the spool 46 is moved in the valve hole 32 due to the pressure difference between valve hole portions upstream and downstream of the orifice 44, connecting the pressure chamber 17 with the passageway 27*b* to return an amount of fluid exceeding a prescribed level into the suction ports of the pumps.

As shown in FIG. 5, the passage hole 21 providing communication between the discharge port 24 and the low-pressure chamber 52 is formed easily by drilling the rear body 2 from a side thereof. Designated in FIG. 5 at 52*a* is an orifice for preventing vibrations of the spool 46. The spool 46 has a known relief valve 55.

The annular groove 53 around the spool 46 in which the orifice 44 opens is stepped, as described above, for the reason that a larger-diameter annular groove portion 53*a* enables the orifice 44 to serve as a variable restrictor in response to operation of the spool 46, successively reducing the amount of flow of the fluid from the discharge port 24 to effect so-called drooping. The drooping is effective in rendering the steering wheel in an automobile rigid while the latter is running at high speeds, thus increasing the stability of the automobile while running.

Figure 2:
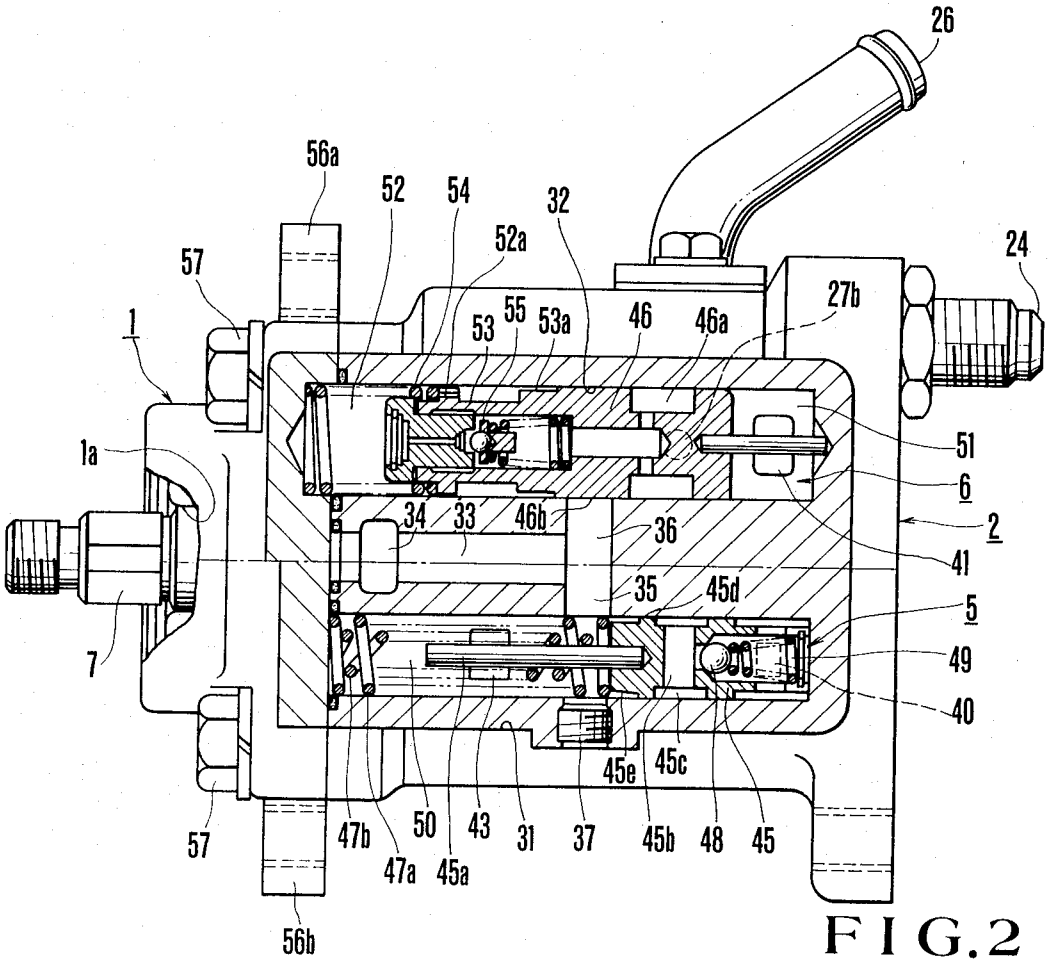
FIGS. 2, 3 and 4 are cross-sectional views taken along lines II—II, III—III and IV—IV, respectively, of FIG. 1.

As illustrated in FIG. 2, the front body 1 has a pair of attachment brackets 56*a*, 56*b* on opposite sides thereof. The front and rear bodies 1, 2 are coupled with each other by four bolts 57.

Operation of the oil pump assembly equipped with the control unit thus constructed will now be described with reference to FIGS. 6 through 9. Designated at P1 is the first pump 3, P2 the second pump 4, T the pressure chamber 28 at the pump suction ports communicating with the tank, and PS a power steering gearbox to be actuated under fluid pressure. Other like or corresponding parts shown in FIGS. 6 through 9 are denoted by like or corresponding reference characters in FIG. 1 through 5.

Figure 6:
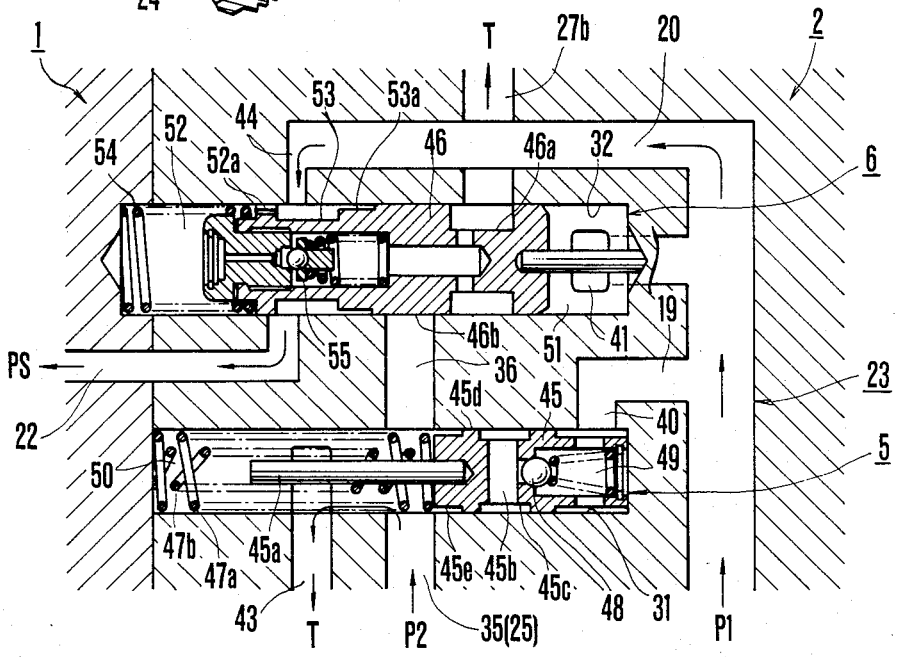
FIG. 6, 7, 8 and 9 are cross-sectional views of an RPM- and pressure-sensitive control unit, illustrating successive operating positions thereof.

FIG. 6 shows the parts position in which the engine RPM is low and the power steering gearbox PS is not operative, that is, the power steering gearbox PS is subjected to no load and the fluid pressure in the main passage 23 is low. In this position, the first and second spool valves 5, 6 are both in their non-operative position. As a result, the fluid under pressure is supplied from the first pump 3 through the main passage 23 to the power steering gearbox PS. The second pump 4 is connected to the tank T through the passage hole 35 (auxiliary passage 25), with the fluid circulating through the second pump 4 and the tank T. Therefore, the second pump 4 undergoes no load. The power steering gearbox PS is not affected when the amount of fluid supplied is small. The flow rate characteristics under this condition are shown as the solid line a in FIG. 10, while the consumed power is indicated by the solid line a in FIG. 11, which is about half of the conventionally consumed power (shown by the broken line b).

Figure 10:
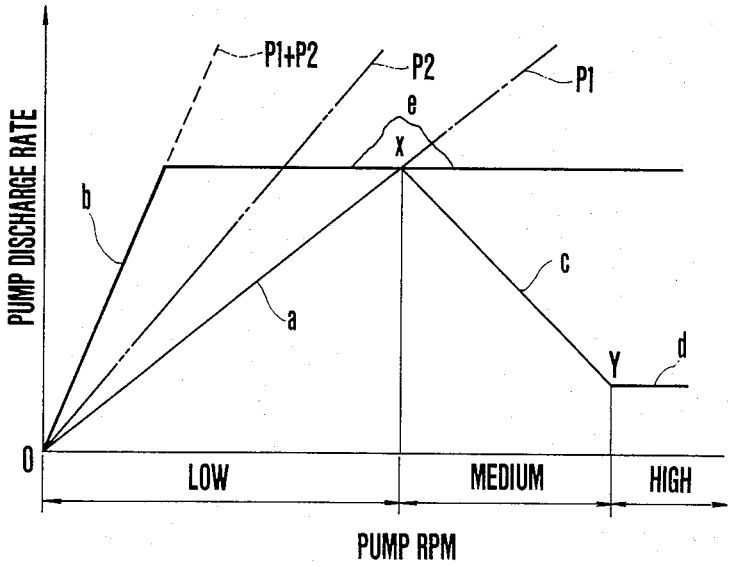
FIG. 10 is a graph showing the relationship between rate of fluid flow and pump RPM.
Figure 11:
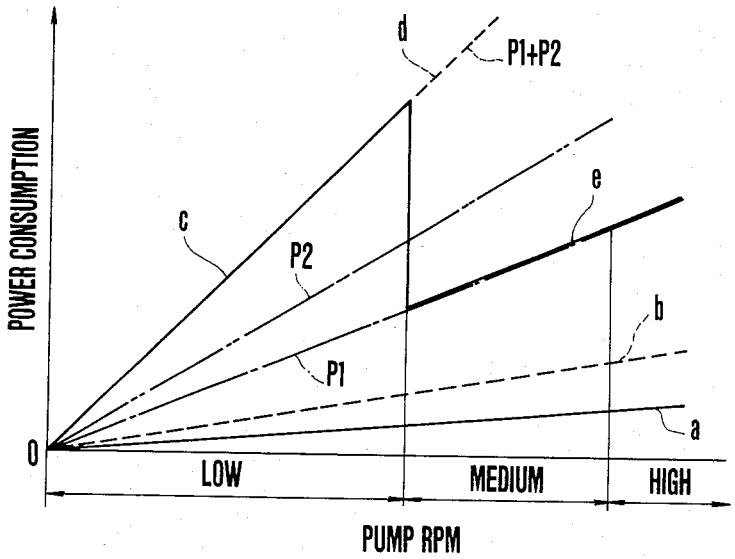
FIG. 11 is a graph showing the relationship between power consumption and pump RPM.

Designated in FIG. 10 at P1 is the amount of fluid discharged by the first pump 3, P2 the amount of fluid discharged by the second pump 4, P1+P2 the added amounts of fluid from the pumps, as they are plotted against the pump RPM.

Designated in FIG. 10 at P1 is the power consumed by the first pump 3, P2 the power consumed by the second pump 4, P1+P2 the power consumed by both of the pumps, as they are plotted against the pump RPM.

Figure 7:
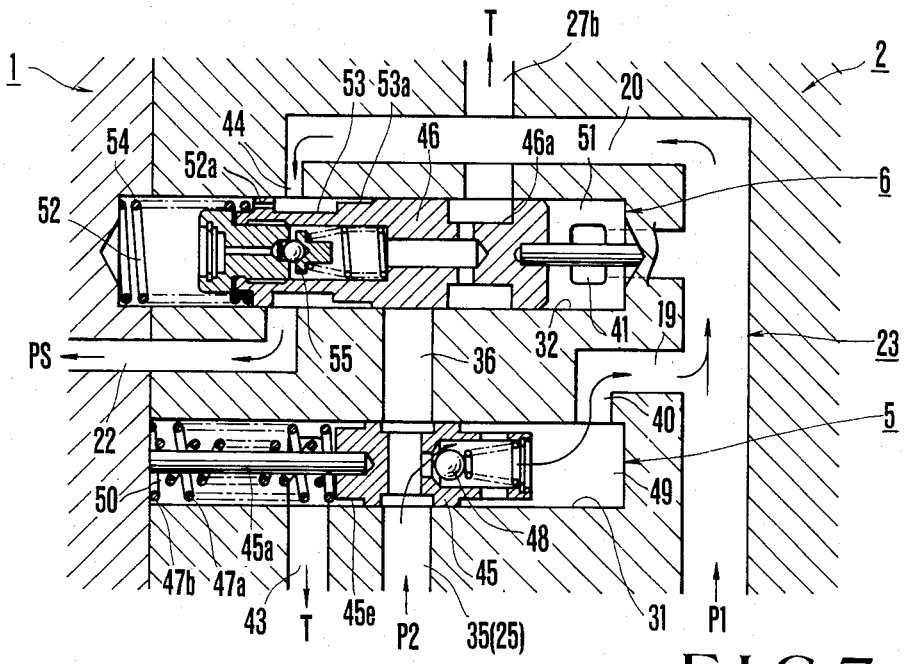

When the power steering gearbox PS is operated to increase the load on the pump assembly while the engine RPM is low with the fluid pressure in the main passage is high, the first spool valve 5 is actuated, as shown in FIG. 7, to disconnect the second pump 4 from the tank T and connect the second pump 4 to the main passage 23 through the check valve 48. The fluid from the second pump 4 is mixed with the fluid from the first pump 3 in the main passage 23, and the mixed fluid is supplied to the power steering gearbox PS to enable the latter to assist the driver in turning the steering wheel without causing any problem in operation. The flow rate characteristics under a higher load is indicated by the solid line b in FIG. 10, and the power consumption by the solid line c in FIG. 11. The power consumption is the same as a conventional rate (shown by the broken line d in FIG. 11). Under this condition, no reduction in the power consumption is achieved.

Figure 8:
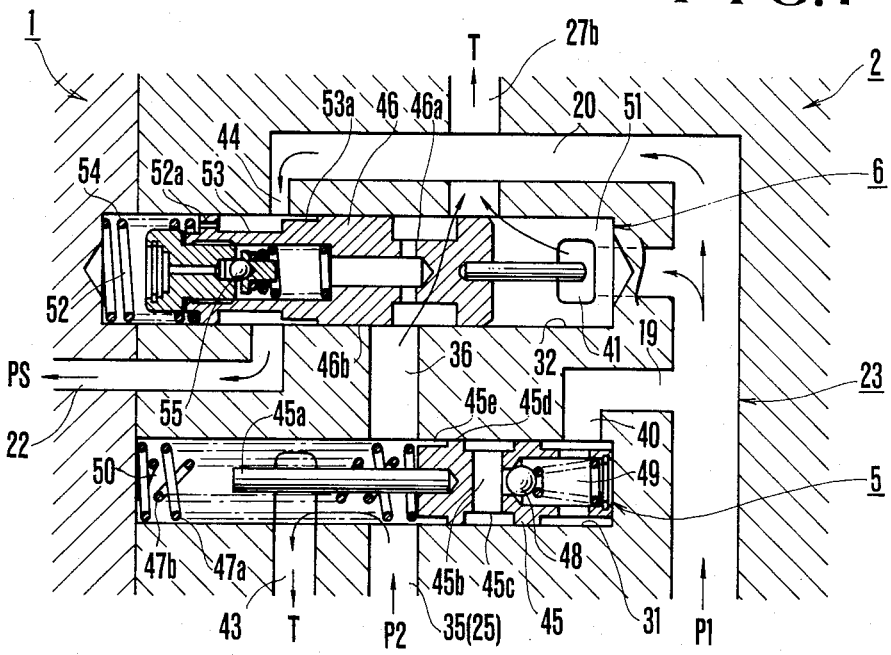

When the amount of fluid from the pumps increases beyond a predetermined level as the engine RPM rises with the power steering gearbox PS remaining non-operative, the fluid pressure in the main passage 23 is high. In this condition, as shown in FIG. 8, the second spool valve 6 is actuated to allow a portion of the fluid flowing from the first pump 3 through the main passage 23 to go into the tank T for thereby controlling the amount of fluid supplied to the power steering gearbox PS at a constant level. The amount of fluid supplied to the power steering gearbox PS is reduced by the drooping due to the large-diameter portion 53*a* of the stepped annular groove 53 as it restricts the orifice 44. As the second spool valve 6 is brought to a prescribed position, the amount of fluid supplied to the power steering gearbox PS is maintained at a constant level. At this time, the first spool valve 5 is disabled, and the fluid from the second pump 4 returns to the tank T via the passage hole 35 (auxiliary passage 25) and the return passage slot 43. A portion of the fluid from the second pump 4 flows through the passage hole 36, the second spool valve 6 and the drain passageway 27*b* back into the tank T. Under this condition, the flow rate characteristics is indicated known by the solid line a, the line c and the line d connected to the line a through points X, Y. The power consumed is sufficiently small as indicated by the solid line a in FIG. 11.

Figure 9:
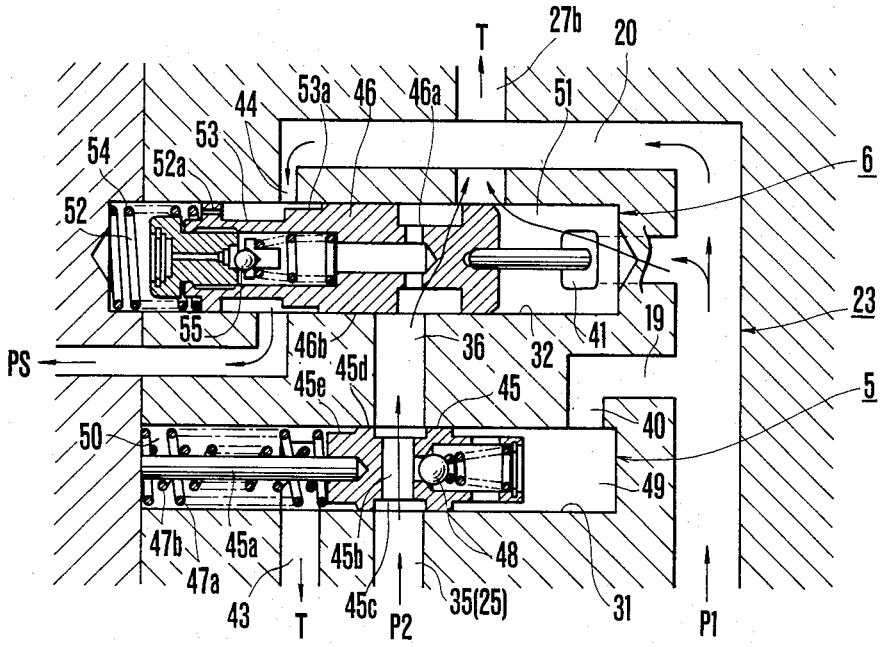

When the power steering gearbox PS is actuated while the engine RPM is high, the fluid pressure in the main passage 23 is increased. As illustrated in FIG. 9, the first spool valve 5 and the second spool valve 6 are both actuated, with the result that the passage hole 35 supplied with the fluid from the second pump 4 communicates with the tank T through the passageway 36, the annular slot 46*a* around the second spool valve 6, and the drain passageway 27*b*. The fluid from the second pump 4 flows into the tank T without opening the check valve 48. A portion of the fluid flowing from the first pump 3 through the main passage 23 also returns across the second spool valve 6 into the tank T. As a consequence, the power steering gearbox PS is supplied with a constant amount of fluid. The flow rate characteristics under this condition is shown by the solid line e in FIG. 10 with the power consumption by the solid line e leading from the solid line c in FIG. 11. The power consumed is about half of a conventional power level (indicated by the broken line d in FIG. 11).

Figure 12:
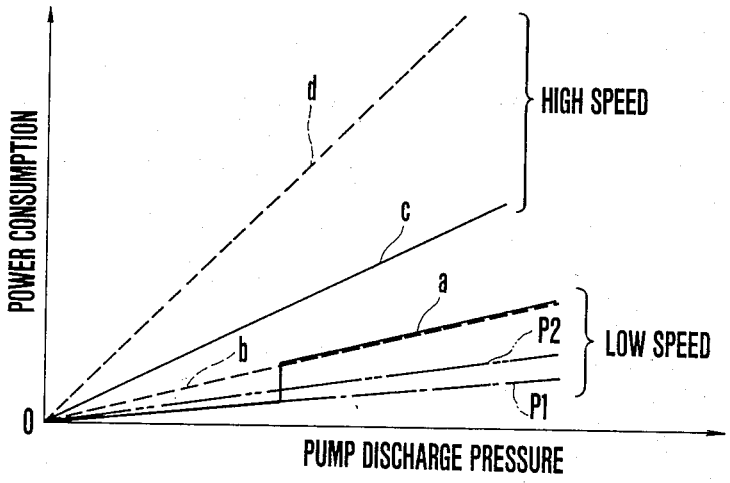
FIG. 12 is a graph showing the relationship between power consumption and discharge fluid pressure.

The energy saving capability of the oil pump assembly according to the present invention is also shown by the graph of FIG. 12 which illustrates the relationship between the power consumption and the pressure of the fluid discharged from the pumps.

When the pump RPM is in a lower range, the power consumption under no load is about half of the convention power consumption (the solid line b in FIG. 12) as shown by the solid line a. As the load increases, the power consumption by the oil pump assembly of the invention becomes equal to that by the conventional oil pumps.

When the pump RPM is high, the power consumption is about half of that by the prior oil pumps (the broken line d in FIG. 12) as indicated by the solid line c. This is because only the first pump 3 supplies the fluid to the power steering gearbox PS in high-speed operation irrespective of the load applied, and the second pump 4 does not supply the fluid to the power steering gearbox PS.

With the arrangement of the oil pump assembly of the invention, the spool valves 5, 6 acting as the directional control valve and the flow rate controlling valve, respectively, are disposed in the valve holes 31, 32 in parallel and close relationship to each other above the pump housing space 8 (FIG. 3) centrally defined in the pump body. The passages by which the valve holes 31, 32 and the pump housing space 8 are interconnected and the passages leading to the fluid outlet and inlet are formed by die-casting and simple drilling. The oil pump assembly is simple and compact in overall construction, can be fabricated and assembled with ease, and is less costly to manufacture.

The pump housing space 8 and the valve holes 31, 32 open at the junction face of the rear body 2 facing the front body 1. The pump components and the valve components such as the spools and the springs can be placed into the pump housing space 8 and the valve holes 3, 32 through their open ends, resulting in an easy assembling procedure. The open ends are sealed off by the front body 1.

The pump bodies of the oil pump assembly of the invention can be drilled to form additional passage holes, and the spools can be changed in shape to meet particular demands. Thus, an oil pump assembly having a control unit designed to operate under different conditions can be fabricated with ease. The oil pump assembly construction of the invention is versatile in various uses and applications.

Although a certain preferred embodiment has been shown and described, it should be understood that many changes and modifications may be made therein without departing from the scope of the appended claims.

What is claimed is:

1. An oil pump assembly comprising a pair of first and second pump bodies coupled to each other, said first pump body defining a pump chamber exclusively of said second pump body, said chamber being open at the end adjacent the second pump body and defining a circular opening peripherally of which there is an annular groove and said second body providing a closure for the chamber defined by said first pump body and defining a cylindrical portion which fits into said circular opening in the first pump body against a sealing ring disposed in said groove, axially-spaced bearings supported in said second pump body, a drive shaft rotatably supported in said axially-spaced bearings, with an end extending into the pump chamber of the first pump body and an oil seal positioned about the shaft in the space between the axially-spaced bearings, said second pump body having a passage therein extending from the space between the oil seal and the inner one of the axially-spaced bearings into the pump chamber defined by the first pump body, first and second pumps mounted on said shaft on the portion of said shaft extending into said pump chamber and supported in concentric relation therein exclusively by said shaft, comprising a first pump cartridge embodying a rotor having a plurality of vanes and an encompassing cam ring within which it is received, a second cartridge comprised of a rotor having peripherally thereof vanes and an encompassing cam ring within which it is received, said cartridges being of smaller diameter than the pump chamber such that there is an annular space peripherally of the cartridges and means confining the cartridges in axially-spaced relation on said shaft within the housing, comprising a first rigid plate disposed about the shaft between the cartridges for axial movement thereon, said first rigid plate defining spaced, parallel surfaces engaged with the facing sides of said cartridges, an annular face peripherally of the cylindrical portion of said second pump body fitting within the circular opening of the first pump body in engagement with the outer side of the second cartridge and a pressure plate disposed within the first pump body defining an annular surface engaged with the outer side of the first cartridge, said pressure plate being supported in said first pump body independently of said shaft and said shaft, cartridges and pressure plate being removable from the pump chamber by separation of said second pump body from the first pump body and said first pump body containing a discharge port, a main passage connecting said first pump to said discharge port, said pumping chamber including a first pump discharge pressure chamber connected with the main passage, a directional control valve operatively mounted in said first pump chamber for selectively connecting said second pump to said main passage, an auxiliary passage providing communication between said second pump and said directional control valve and a flow control valve for selectively connecting the main passage and the pressure chamber located in the main passage between the first pump and the discharge port downstream of the direction control valve and serving as a second pump discharge pressure chamber.

2. An oil pump assembly according to claim 1, wherein said first pump body has a valve hole communicating between said main passage and said auxiliary passage, said directional control valve comprising a spool valve having a spool slidably disposed in said valve hole.

3. An oil pump assembly according to claim 2, wherein said pump housing chamber and said valve hole have open ends closed off by a surface of said second pump body.

* * * * *

UNITED STATES PATENT AND TRADEMARK OFFICE

CERTIFICATE OF CORRECTION

PATENT NO. : 4,538,966

DATED : September 3, 1985

INVENTOR(S) : Nikaido

It is certified that error appears in the above-identified patent and that said Letters Patent is hereby corrected as shown below:

Col. 5, l. 46: change "33" to --35--

Col. 7, l. 62: change "FIG." to --FIGS.--

Col. 8, l. 27: delete "is"(first occurrence)

Col. 8, l. 65: delete "known"

Signed and Sealed this

*Eighteenth* Day of *March 1986*

[SEAL]

*Attest:*

DONALD J. QUIGG

*Attesting Officer*

*Commissioner of Patents and Trademarks*